United States Patent [19]

Guenther et al.

[11] 4,163,438

[45] Aug. 7, 1979

[54] ROTARY VALVE TIMING APPARATUS

[75] Inventors: William D. Guenther, Hagerstown, Ind.; Philip J. Mazziotti, Toledo, Ohio

[73] Assignee: Dana Corporation, Toledo, Ohio

[21] Appl. No.: 635,714

[22] Filed: Nov. 26, 1975

[51] Int. Cl.[2] ..... F01L 7/00

[52] U.S. Cl. ..... 123/190 A; 123/80 R; 123/190 R; 137/624.17

[58] Field of Search ..... 123/190 R, 190 A, 190 BD, 123/80 R; 137/624.15, 90.15, 625.17

[56] References Cited

U.S. PATENT DOCUMENTS

| | | | |
|---|---|---|---|
| 1,578,581 | 3/1926 | Casna | 123/190 A |
| 1,635,963 | 7/1927 | Seifert | 123/190 A |
| 2,141,428 | 12/1938 | Carroll | 137/625.17 |
| 2,183,024 | 12/1939 | Large | 123/190 A |
| 2,798,466 | 7/1957 | Rzepecki | 123/190 A |
| 3,650,295 | 3/1972 | Smith | 137/624.15 |

FOREIGN PATENT DOCUMENTS

| | | | |
|---|---|---|---|
| 102214 | 10/1937 | Australia | 123/190 R |
| 1159690 | 12/1963 | Fed. Rep. of Germany | 123/190 R |

*Primary Examiner*—Charles J. Myhre
*Assistant Examiner*—David D. Reynolds
*Attorney, Agent, or Firm*—Barker, Emch, Schaffer & Todd Co.

[57] ABSTRACT

A rotary valve system for an internal combustion engine is disclosed. Through the provision of an axially movable valve rotor, the system is capable of variable valve opening duration and timing. Ports in the rotor or in the rotor housing, or both, have edges inclined with respect to the axis of the rotor, so that relative axial movement of the rotor and housing ports effects a change in the timing of valve opening and closing. Valve opening duration is also varied. An actuator system which controls the axial translation of the rotor during operation of the engine considers factors affecting engine performance such as engine speed, road speed and engine loading in determining the optimum valve timing and duration setting.

2 Claims, 20 Drawing Figures

ROTARY VALVE TIMING APPARATUS

BACKGROUND OF THE INVENTION

The invention relates to internal combustion engines, and more particularly to a rotary valve system for such engines, the system being capable of varying timing and duration.

The basic structure and many advantages of rotary intake and exhaust valves for internal combustion engines are well known. The principal advantages are in the areas of maintenance and dependability, cost, ease of assembly, and engine size and weight.

In a typical internal combustion engine, engine efficiency is comprised by the provision of fixed valve timing and duration. This is true of conventional camshaft engines and also of typical rotary valve systems. The valve opening specification for a given engine is chosen for average engine load and speed conditions expected. A compromise thus results in that the engine is rendered much less efficient at differing engine conditions than would be the case if optimum valve settings could be employed for such differing conditions. Typically, valve overlap is too great at low engine r.p.m., and not sufficient at high r.p.m. and high engine loading, due to well known variations in the effects of charge momentum under varying conditions.

Various apparatus have been suggested for providing adjustable valve timing in connection with rotary valves. One such arrangement involves the use of blocking devices which may be added to or subtracted from the port opening leading into the valve rotor from either the intake or the exhaust manifold. Depending on the positioning of the blocking devices, the port may be modified to advance, retard, and/or modify the duration of the valve-open period. Of course this modification can only be made when the rotary valve assembly is dismantled.

Another suggested adjustable valve timing apparatus involves the use of an adjustable sleeve in the rotor housing in the position of the manifold side port. The sleeve, which includes an opening serving as the port, is circumferentially movable with respect to the valve rotor, so that the position of valve opening and closing can be varied and valve timing is accordingly adjusted. The timing can actually be adjusted during operation of the engine, in response to changing conditions, thereby somewhat broadening the optimum efficiency ranges of the engine in which the system is incorporated. However, besides presenting maintenance problems due to the complexity of the apparatus at the manifold side housing port, this type adjustable valve timing does not provide for adjustment of the duration of valve opening. Thus under conditions when it would be desirable to have a certain degree of valve overlap around top dead center piston position, and another degree of valve overlap around bottom dead center, these specific requirements cannot be met and engine efficiency is reduced.

SUMMARY OF THE INVENTION

The adjustable valve timing apparatus of the invention includes valve rotors which are axially movable in their housings during operation of the engine. The ports in either the housing, the rotor itself, or both include leading and trailing edges which are angled with respect to the axis of the rotor. These angled edges in conjunction with axial movement of the rotor provide for variation in valve opening timing, valve closing timing and duration of valve opening. Relative axial movement between the ports of the housing and of the rotor shifts the rotor position at which initial opening of the valve occurs, as well as rotor position at which completion of valve closing occurs. Valve duration is varied along with timing, so that for a given valve timing, there is a corresponding valve duration which would be desirable for selected timing.

In a preferred embodiment of the invention, the cooperating ports of both the rotor and the rotor housing have angled leading and trailing edges, each port generally assuming the shape of a triangle. The leading edges of both ports are parallel, and the trailing edges of both are parallel, providing for abrupt and complete opening and closing of the valve, rather than a gradual decrease in area of the valve during opening or closing.

For adjustment of the axial position of the valve rotor during operation of the engine, an actuator system is connected to a rotor corresponding to a bank of firing cylinders. The actuator system takes into account both engine speed and engine loading conditions, the latter typically being determined by vacuum measurement, in selecting and setting the optimum valve timing and duration for the sensed condition. Both intake and exhaust valve rotors can be controlled as to timing and duration by axial movement effected by the actuator system. The actuator system may employ various forms of known sensing and control apparatus, and the specific components of such apparatus do not form a part of the invention. Example actuator systems are shown in Stewart, Practical Guide to Fluid Power, pages 12–15 (1966). Rotary cylinders, as described in Bradbury, Hydraulic Systems and Maintenance, pages 103—103 (1972) and in Holebock, Hydraulic Power and Equipment, page 192 (1968), may be incorporated into such systems to provide the ability to axially move rotating members.

The adjustable rotary valve system of the invention may be advantageously employed in almost any type internal combustion engine, including stratified charge engines, engines operating on a two-stroke cycle and diesel engines. Any such engine realizes better fuel economy by the system of the present invention, due to the use of the optimum combustion cycle for each engine condition. Undesirable engine emissions are also greatly reduced by the adjustable valve system, particularly at low engine r.p.m. and idle in a typical internal combustion engine. An additional benefit of the system is reduced engine noise. Particularly at engine idle, where the present system retards valve timing, reduces valve opening area and provides minimum valve opening duration, unlike standard cam engines, combustion noise is significantly diminished.

DESCRIPTION OF THE PREFERRED EMBODIMENT

Figure 1:
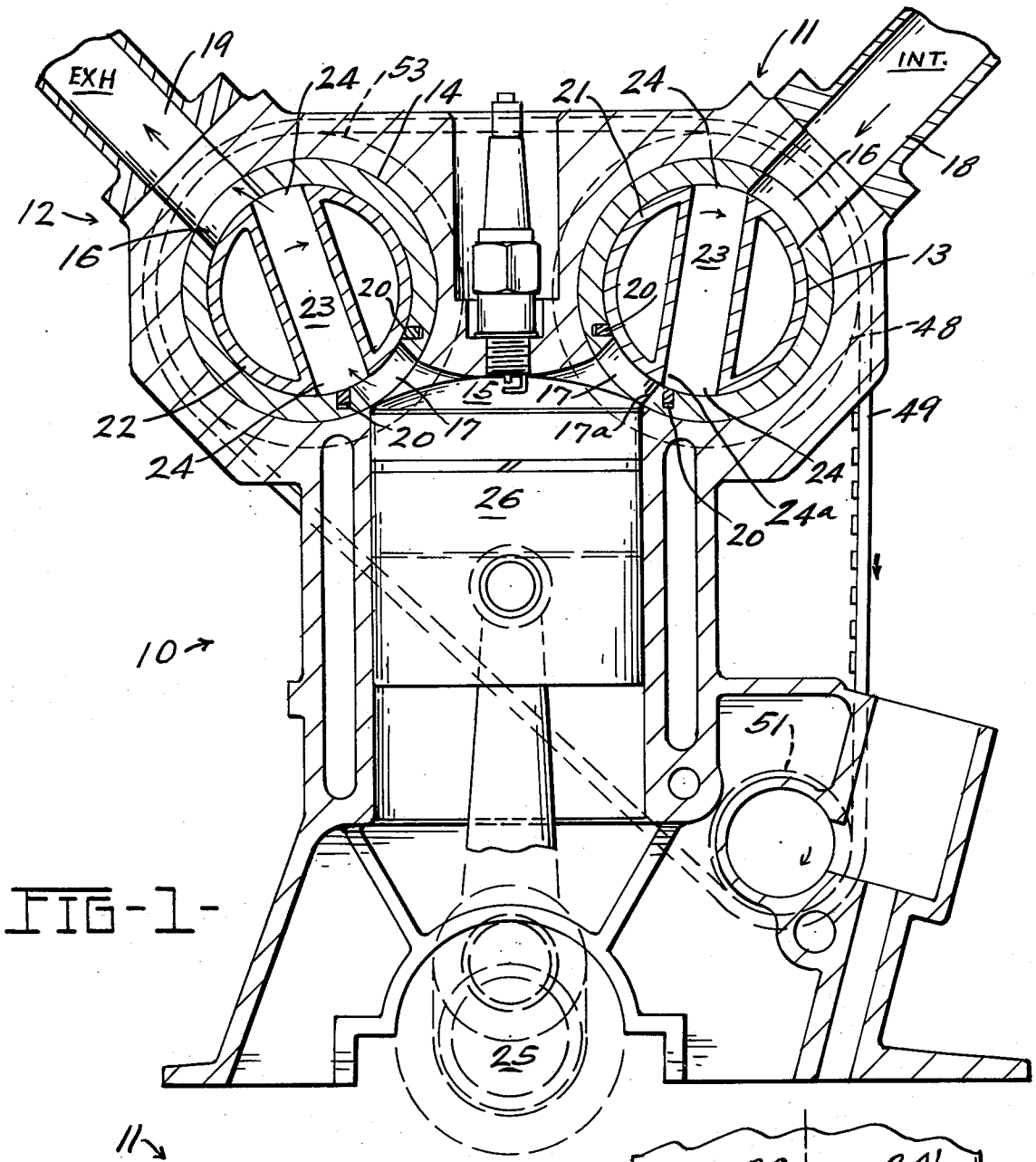
FIG. 1 is an elevational cross sectional view showing a portion of an internal combustion engine including the rotary valve system of the invention.

In the drawings, FIG. 1 shows in cross section a portion of an internal combustion engine 10 including rotary valves 11 and 12 for intake and exhaust, respectively. The valves 11 and 12 include valve housings 13 and 14, each having first and second openings 16 and 17. The first openings 16 are aligned with and in communication with conduits 18 and 19 connected to the intake manifold and the exhaust manifold (neither shown), respectively, while the openings 17 are in communication with a combustion chamber 15 as shown. As will be seen below, one of the ports 16 or 17 on each valve 11 and 12, preferably the port 17, has leading and trailing edges which are angled with respect to the axis of the cylindrical housings 13 or 14. Rotatable and axially movable within the stationary housings 13 and 14 are valve rotors 21 and 22. Each rotor may be designed to rotate in either direction, but it will be assumed in this preferred embodiment that both rotors 21 and 22 rotate clockwise as viewed in FIG. 1.

Each of the valve rotors 21 and 22 includes a generally diametric through passageway 23 defining similarly shaped rotor ports 24 at either end of the passageway. In FIG. 1 the intake rotor 21 is shown with a leading edge 24*a* of one of its ports 24 in alignment with a leading edge 17*a* of the housing port 17. The opposite intake rotor port 24 has already reached the housing port 16, since at this end of the housing the point at which the ports of the rotor and the housing meet is not critical. In this preferred embodiment, these manifold side ports are sized and positioned to be open whenever the combustion side ports are open, so that valved timing and duration is controlled solely by the interaction between the combustion side housing port 16 and the rotor port 24. It is to be understood that the timing and duration could be controlled at the manifold side ports as well. Thus, in FIG. 1 the intake valve 11 is at the point of initial opening. Similarly, on the other side of the combustion chamber 15, the exhaust valve 12 is just about to close. This corresponds to the fact that even at the maximum retarded position of the adjustable valve system, there is preferably a slight overlap between intake opening and exhaust closing. As shown in FIG. 1, a crankshaft 25 and a piston 26 associated with the intake and exhaust valves 11 and 12 are approximately at top dead center position. The actual piston position is slightly below (prior to) top dead center, since both valves are slightly open at top dead center in accordance with the valve overlap.

Figure 2:
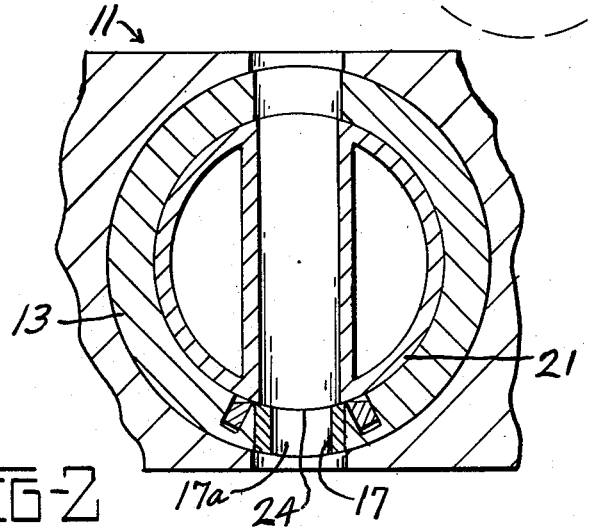
FIG. 2 is an enlarged sectional view showing a valve rotor and rotor housing, with the valve in the open position.
Figure 11:
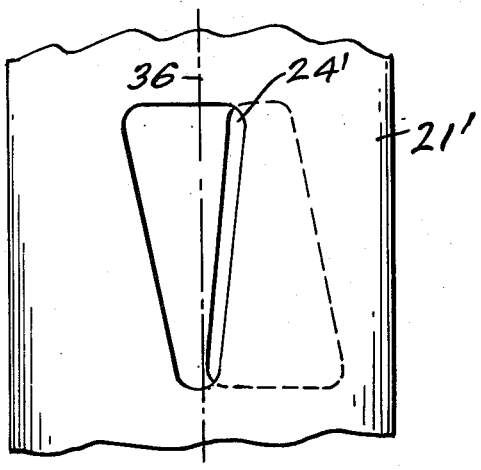
FIG. 11 is a view showing an alternative rotor port configuration.

FIG. 2 shows one of the intake and exhaust rotary valve assemblies 11 and 12 in an enlarged cross sectional view. Although the discussion below applies to either valve, the valve shown in FIG. 2 may be assumed to the intake valve 11, and the discussion focuses on the intake valve. The rotor port 24 and rotor housing port 17 are shown such that the timing and duration of the valve assembly 11 are at the maximum retarded position.

FIGS. 3 through 5 and FIGS. 7 through 9 diagrammatically indicate various relative positions of the housing port 17 and the the rotor port 24 as the rotor port progresses to the right in the figures. The valve rotor, which is axially movable in the housing as discussed above, is represented in the maximum advance position in FIGS. 3 to 5 and in the maximum retarded position in FIGS. 7 through 9.

Figure 6:
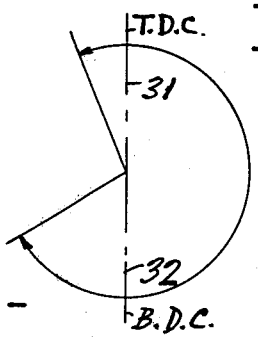
FIG. 6 is a graphic representation of the advanced timing condition.
Figure 10:
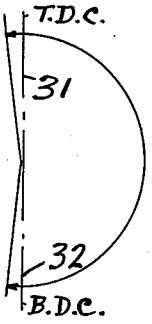
FIG. 10 is a graphic representation similar to that of FIG. 6 but illustrating the maximum retarded condition.

FIGS. 6 and 10 graphically show the crankshaft angles through which the valve 11 is open at maximum timing advance and maximum timing retard, respectively. The upper vertical radial lines 31 represent top dead center piston position, while the lower vertical radial lines 32 represent bottom dead center piston position, so that the difference between the two positions is 180° of the crankshaft, with a total of 360° of the crankshaft depicted. At maximum advance, the valve may open in the neighborhood of 30 crankshaft degrees prior to top dead center, and remain open through approximately 60 crankshaft degrees beyond bottom dead center. As FIG. 10 indicates, valve opening and closing are only a few degrees before and after top dead center and bottom dead center, respectively, when valve timing is in the maximum retarded position. It should be noted that one full revolution of the crankshaft corresponds to only one-quarter revolution of the intake and exhaust valves 11 and 12 for the four-stroke cycle engine 10 depicted in FIG. 1. In a half revolution of the valve rotor 21 of the intake valve 11, for example, the engine has completed an entire cycle, since the rotor 21 has returned to a similar position, the two oppposed ports 24 of the rotor 21 being identical.

The rotor housing port 17 of FIGS. 3 through 5 and FIGS. 7 through 9 includes a first generally rectangular portion 33 having leading and trailing edges 33*a* and 33*b* parallel to the axis 36 of the rotor, and a second portion 34 having angled leading and trailing edges 34*a* and 34*b*. Both these edges angle outwardly from the rectangular portion 33, with the leading edge 34*a* angling gently and the trailing edge 34*b* angling more sharply as will be further described below. This puts the trailing edge of the port area 34 more remote from the main rectangular area 33 than is the leading edge 34*a*. As explained below, this corresponds to the fact that when valve timing is "advanced" (the term as used herein implies earlier valve opening and later valve closing), the delay in valve closing beyond bottom dead center is greater than the lead in valve opening before top dead center. This concept, illustrated in FIG. 6, is well known in the art as advantageous under conditions requiring valve timing advance and has in fact been reflected in the design of conventional camshafts.

Figure 3:
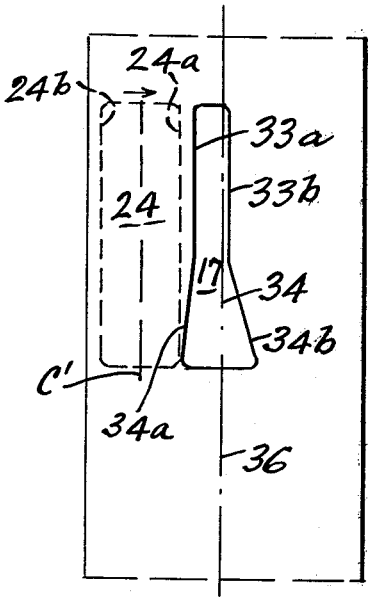
FIGS. 3, 4 and 5 are schematic representations showing the adjustable valve assembly of the invention in a position of maximum advance, the figures demonstrating the progression of the rotor port across the housing port.
Figure 4:
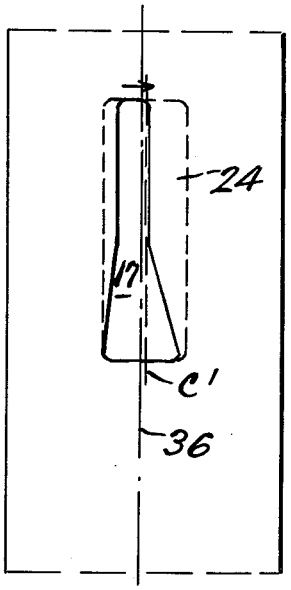
Figure 5:
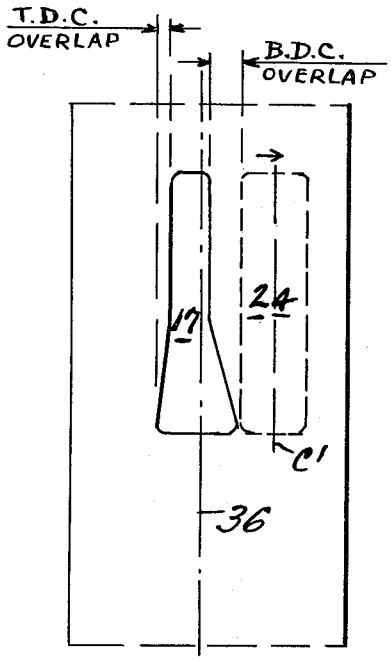

FIGS. 3, 4 and 5 demonstrate the progression of the rotor port 24 from the point of initial valve opening to the point of final valve closure, at the maximum advanced setting. FIG. 6 shows the valve-open crankshaft angle represented by this setting. As can be seen by the figures, the initial portion of valve opening occurs gradually along the leading edge 34*a* of the port 16, with the open area increasing from a small triangle to a larger triangle at the point where the leading edge 24*a* of the rotor port meets the leading edge 33*a* of the rectangular portion 33 of the housing port 17. Similarly, when the valve is closing, the open area is a diminishing triangle due to the interaction of the angled trailing edges 24*b* and 34*b*, so that the valve closes gradually.

Figure 7:
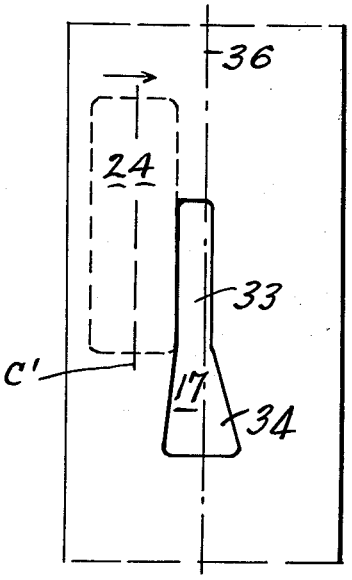
FIGS. 7, 8 and 9 are further schematic representations demonstrating the progression of the rotor port across the housing port when the valve timing is in its maximum retarded position.
Figure 8:
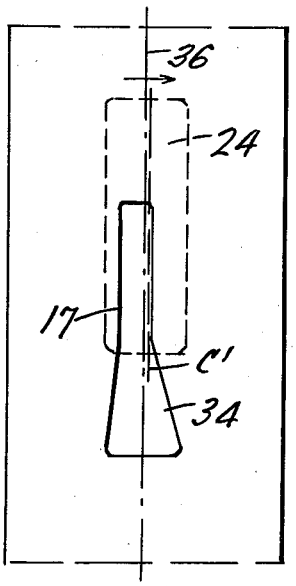
Figure 9:
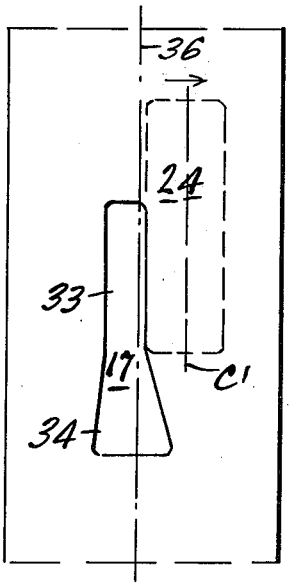

FIGS. 7, 8 and 9 illustrate the progression of the rotor port 24 across the housing port 17 from the point of valve opening to the point of valve closing, with the valve timing at its maximum retarded setting. The rotor port 24 is axially shifted to the maximum extent possible from its position shown in FIGS. 3, 4 and 5. As FIG. 7 illustrates, when compared with FIG. 3 above, the point of valve opening is now farther along in the travel of the rotor and thus later in time. Similarly, FIGS. 9 and 5 show that the point of valve closure is considerably earlier in time. As FIG. 10 demonstrates, valve opening and closing now occur close to top dead center and bottom dead center crank shaft positions, respectively, resulting in a considerably shorter valve-open duration. FIGS. 7, 8 and 9 also show that valve opening and closing is now more abrupt, since only the rectangular area 33 of the housing port 17 is involved. The maximum valve opening area is also considerably reduced, as seen by a comparison of FIGS. 8 and 4. This is desirable in that, as will be seen below, valve timing positions toward maximum retard correspond to low engine load and r.p.m. conditions wherein the size of the valve opening can and should be small, because of low fuel requirements.

It can easily be seen from FIGS. 3 through 5 and FIGS. 7 through 9 that axial positions of the rotor port 24 intermediate the maximum position shown in the two groups of figures will result in intermediate settings of valve timing and duration, because of the inclination of the leading and trailing edges 34*a* and 34*b* of the housing port 17.

FIGS. 11 through 17 relate to a second and preferred embodiment of the adjustable rotary valve timing apparatus. These figures depict a rotor 21' having a through passageway 23' defining ports 24' of a generally triangular shape. The ports 24' each include a leading edge 24*a'* which is inclined at a small angle to the axis 36 of the rotor. A trailing edge 24*b'* of each port is inclined at a greater angle to the axis 36.

Figure 12:
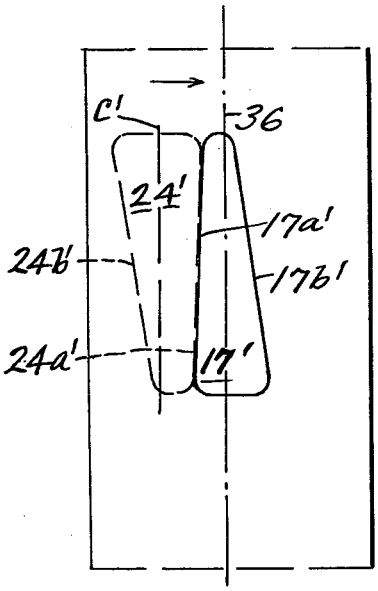
FIGS. 12, 13 and 14 are views similar to FIGS. 3, 4 and 5, at maximum valve timing advance, but showing the alternative rotor port configuration of FIG. 11 and a corresponding housing port configuration.
Figure 13:
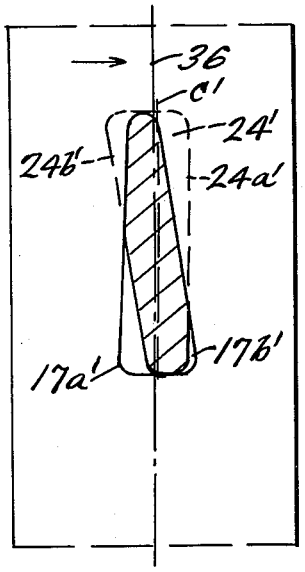
Figure 14:
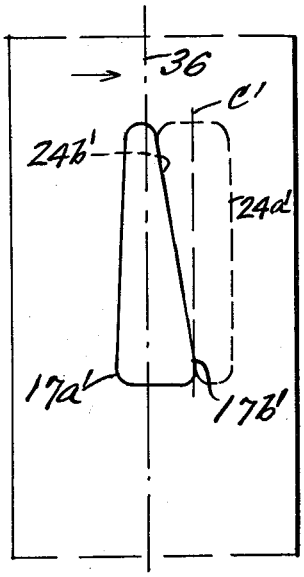
Figure 15:
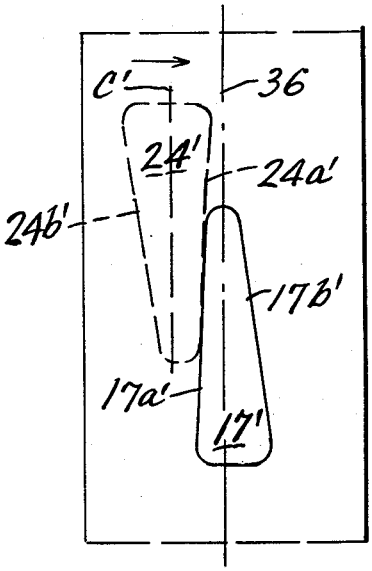
FIGS. 15, 16 and 17 are views similar to FIGS. 12, 13 and 14 but with valve timing at maximum retarded position.
Figure 16:
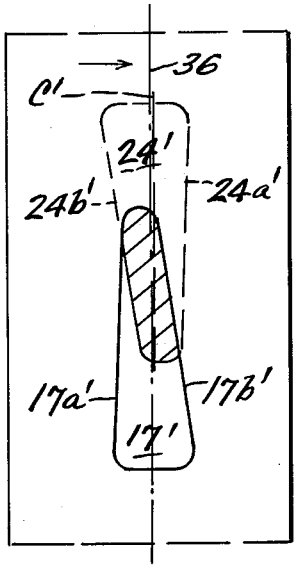
Figure 17:
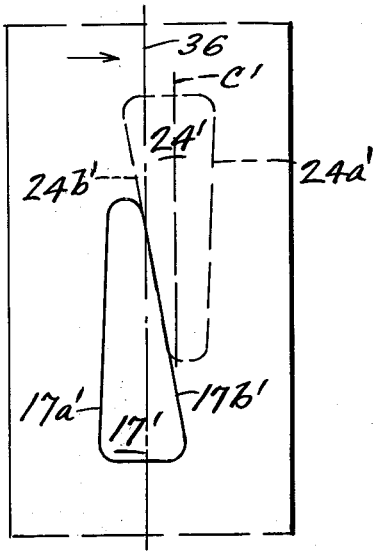

As shown in FIGS. 12 through 17, the modified apparatus includes a generally triangular shaped housing port 17' complementary to the rotor port 24'. Leading edges 17*a'* and 24*a'* of the housing port and the rotor port, respectively, are parallel, as are trailing edges 17*b'* and 24*b'*. FIGS. 12 through 14 show the progression of the rotor port 24' across the housing port 17', from the point of opening to the point of closure of the valve, with the valve timing set at maximum advance position. FIGS. 15 through 17 show the corresponding progression when the valve rotor 21' has been shifted to its maximum retard position. The views thus show the same progression as that of FIGS. 3 through 5 and FIGS. 7 through 9, and the graphical representations of FIGS. 6 and 10 apply also to FIGS. 12 through 14 and FIGS. 15 through 17, respectively.

As is demonstrated by the drawings, the axial shifting of the relative positions of the triangular ports 24' and 17' varies the timing of the opening and closing of the valve similarly to the ports discussed above. Similarly, a smaller valve opening area is produced at maximum retard, as shown in FIG. 16. In fact, the ports 17 and 24 and the ports 17' and 24' are designed to produce the same effect on valve timing and duration, the effect being illustrated in FIGS. 6 and 10.

The triangular ports are preferred because they provide for an abrupt and uniform opening and closing of the valve. This is because, as discussed above, the leading edges of the cooperating ports are parallel and the trailing edges are also parallel. Thus, the valve opens along a line which runs the entire length of the resulting valve opening area, as shown in FIGS. 12 and 15, rather than gradually as with the first embodiment discussed above. The shape of the resulting opening is roughly that of a shifting parallelogram, except that the ports may have rounded corners as illustrated.

The shape of the triangular openings of the lower housing port 17' and the rotor ports 24' of the preferred embodiments of the invention is determined by the several factors which affect engine design. Thus, projected engine load fuel requirements and engine speed will affect the port design.

If, for example, the projected engine demand requires a range of intake valve timing which is variable from a minimum retarded condition (opening at a point near top dead center at the beginning of the piston intake stroke) to one of maximum advance (opening before the piston reaches top dead center), the slope of the leading edges 17*a'* and 24*a'* of the ports 17' and 24' must be relatively steep, away from a centerline C' of these ports.

Thus, the greater the angle between the centerline C' and the leading edges 17*a'* and 24*a'*, the more the timing of the valve can be "advanced" (to open sooner) upon maximum shifting of the intake rotor 21 in its housing 13 as explained above. Similarly, the greater the angle between the trailing edges 24*b'* and 17*b'*, the longer duration of valve opening can be imparted upon maximum shifting of the rotor 21'. The same is true with respect to timing the exhaust port.

Likewise, any intermediate timing to be afforded either the intake or exhause ports 24' are determined by the angular relationship between the centerline C' and the points along the leading and trailing edges which first respectively "open" the valve and then "close" the valve depending on the amount of axial shifting of the rotor 21 or 22. The shape of the ports illustrated in FIGS. 3 through 5 and 7 through 10 is similarly determined.

Figure 18:
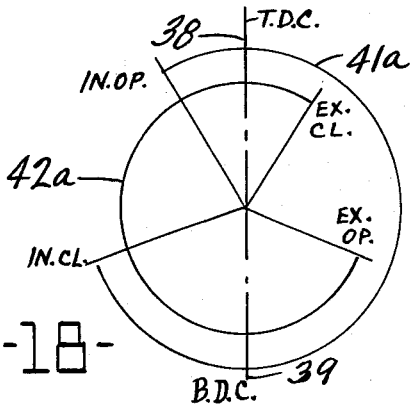
FIGS. 18 and 19 are graphic representations showing valve overlap of intake and exhaust valves at maximum advance and at maximum retard, respectively.
Figure 19:
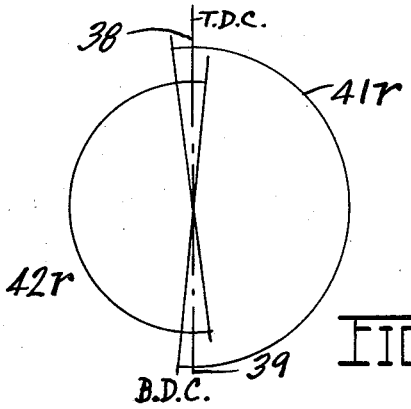

FIGS. 18 and 19 are diagrams illustrating valve overlap. FIG. 18 shows valve overlap at maximum advance, while FIG. 19 shows overlap at maximum retard, for both types of valve ports described above. Upper and lower vertical radial lines 38 and 39 represent top dead center and bottom dead center piston positions, respectively, as indicated. Outer arcs 41*a* and 41*r* represent the crankshaft angles through which the intake valve is open, while inner arcs 42*a* and 42*r* represent the crankshaft angles through which the exhaust valve is open. As in FIGS. 6 and 7 discussed above, the direction of the crankshaft travel is assumed to be clockwise in these diagrams, which are representative of a standard format well known in the internal combustion engine art for depicting valve overlap. The overlap of the intake and exhaust arcs at the top of the diagrams, in the vicinity of top dead center piston position, represent actual periods when the intake and exhaust valves of a firing cylinder are both open. However, the apparent overlap around bottom dead center piston position does not represent a period when both valves are open. Two full revolutions of the crankshaft comprise a cycle in a four-stroke cycle engine, so that while the bottom dead center position for the intake arcs 41*a* and 41*r* represents bottom dead center at the end of the intake stroke, bottom dead center position for the exhaust arcs 42*a* and 42*r* represents the beginning of the exhaust stroke, which does not immediately follow the intake stroke but is 360° later. As FIGS. 18 and 19 indicate, the intake and exhaust arcs may be symmetrical, i.e., intake opening may precede top dead center by the same angle that exhaust closing follows top dead center, and likewise for intake closing and exhaust opening with respect to bottom dead center.

Figure 20:
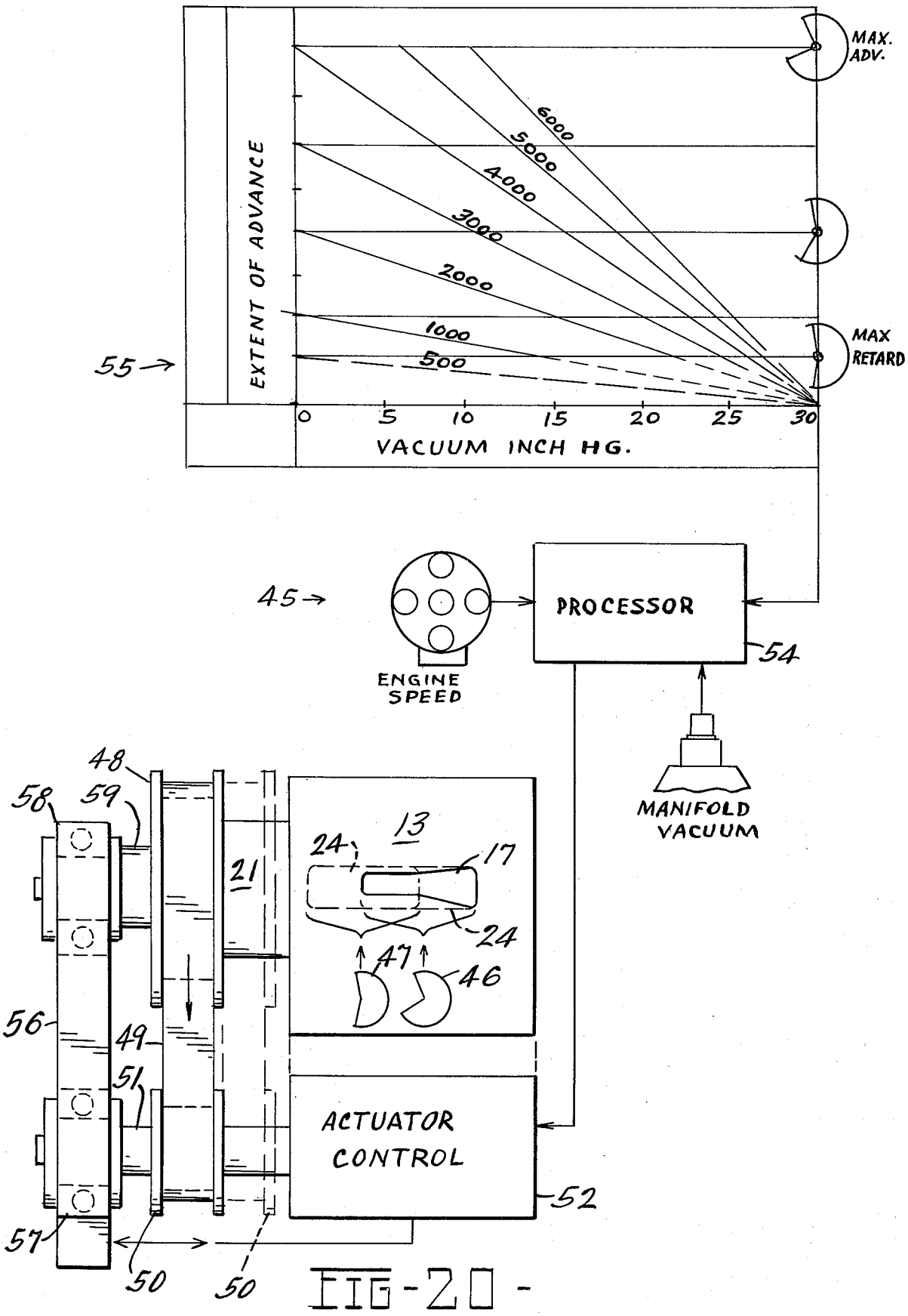
FIG. 20 is a schematic representation of a valve timing adjustment actuator system which shifts the position of the valve rotor during operation of the engine.

FIG. 20 schematically indicates a valve timing actuator system 45 which may be employed in connection with the adjustable valve timing and duration system of the invention. The valve housing 13 with its port 17 is indicated, with the port 24 of the axially movable rotor 21 shown at maximum advance and maximum retard positions, as indicated by the diagrams 46 and 47, respectively. At the end of the rotor 21 may be a pulley 48 with a timing belt 49 driven in timed relationship with the engine 10, connecting with a second pulley 50 extending from a shaft 51 of an actuator control 52. The actuator control is capable of shifting the pulley 50 axially to any position between the two positions indicated in FIG. 20. Such movement of the pulley 50, while it and the rotor pulley 48 are rotating, will move the pulley 48 and rotor 21 along with the actuator pulley 50. However, a rigid connecting link 56 having bearing connections 57 and 58 to the actuator shaft 51 and to a shaft 59 extending from the rotor 21 may be provided for positive control of the rotor 21.

As shown in FIG. 1, the timing belt 49 may extend from the actuator pulley 50 around both the intake rotor pulley 48 and an exhaust rotor pulley 53, so that intake and exhaust timing are both controlled by the actuator control 52. Rigid connecting links (not shown) such as the link 56 may extend from the actuator shaft to both rotors. The timing belt and pulleys are shown for illustrative purposes only; any suitable drive means and any suitable axial shifting mechanism may be used, and they may be either integral or separate.

The internal mechanism of the actuator control 52 may comprise any suitable and well known actuator apparatus. The actuator is rotationally driven by the crankshaft, since the speeds of the actuator and of the valve rotor 21 must always be proportional to that of the crankshaft. Connection may be by spline (not shown), so that the actuator can receive and deliver rotary motion while its shaft 51 is shifted axially. The shifting mechanism may be driven by pneumatic, hydraulic, electric or purely mechanical apparatus.

The actuator control 52 is governed in its shifting function by a processor 54 which senses both engine speed and manifold vacuum (to determine engine load) and sends the appropriate signal to the actuator control 52. The exemplary chart 55 shown associated with the processor 54 illustrates how the processor utilizes engine speed and manifold vacuum data to determine the proper signal to be sent to the actuator control 52. The scales and values on the chart are only examples and will vary with different engines. The horizontal scale on the chart represents manifold vacuum in inches of mercury, while the vertical scale represents the extent of valve timing advance. The family of oblique lines represents engine r.p.m. as indicated. Valve timing may be varied between the line indicating maximum retard to the uppermost line indicating maximum advance. Note that all engine speed lines are dashed below the maximum retard line, since no further retardation occurs. The entire 500 r.p.m. line lies below maximum retard.

If, for example, engine load produces a manifold vacuum of 10 inches of mercury and engine speed is 3000 r.p.m., the processor 54 would select a timing setting approximately corresponding to the middle setting graphically indicated at the right of the chart 55. As the chart indicates, at the highest values of manifold vacuum (minimum engine load), valve timing is at maximum retard, regardless of engine speed. Similarly, at minimum engine speed, the timing is at maximum retard, regardless of engine loading.

The processor 54 which governs the actuator control 52 according to engine speed and load and the formula graphically illustrated by the chart 55 may utilize any of a variety of types of apparartus capable of receiving a plurality of variables, processing the variables according to a predetermined formula, and sending a variable signal to a controller in accordance with the formula.

It should be understood that various aspects of the preferred embodiments described above may be altered or re-arranged without affecting the operation of the adjustable valve timing system. The shaped ports can be located in the rotor itself rather than in the housing, in the case of the embodiment of FIGS. 3 through 9 described above. In the embodiment of FIGS. 12 through 17, of course, the shaped ports are located in both the housing and the rotor. In the case of either embodiment, the shaped ports of the rotor housing can be located at the manifold side of the housing rather than at the combustion side. These shaped ports can also be provided at both locations in the housing.

The adjustable valve timing and duration apparatus of the invention can also be employed in diesel engines. Although fuel is injected into the combustion cylinders of such an engine, the air which enters the combustion chambers through valves can be routed through adjustable rotary valves as with the fuel-air charge discussed above. Similarly, the exhaust valves can be adjustable rotary valves. The operation of the diesel is subject to the same considerations discussed above, including factors related to variations in charge (air) velocity and momentum, so that dynamic adjustment of the valve timing and duration of both the intake and exhaust valves can result in the elimination of timing compromise and a corresponding increase in engine efficiency.

The apparatus of the invention can also be used in connection with two-stroke cycle engines, wherein dynamic adjustment of timing and duration has the same advantageous effects.

It is to be understood that the above description of the preferred embodiments of the invention is illustrative of our best known mode of carrying out our invention which is set forth in the following claims.

I claim:

1. Adjustable valve timing apparatus for an internal combustion chamber, said apparatus chamber comprising a valve housing defining a housing port in open communication with the combustion chamber, said housing port having leading and trailing edges, a driven valve rotor within said valve housing and having at least one open passageway through said rotor and defining opposed open rotor ports for registry with said housing port upon rotation of said valve rotor, said rotor ports each having leading and trailing edges for registry with said edges of said housing port, and means adjacent said housing for shifting relative axial positions of said housing port and said rotor ports to adjust timing, wherein said leading and trailing edges of said housing port are sloped to define opposite sides of a first triangle having a first orientation with respect to the axis of said rotor and said leading and trailing edges of said rotor port define opposite sides of a second triangle having a second orientation with respect to the axis of said rotor, and second triangle being inversely oriented with respect to said first triangle whereby said leading edges are parallel when said ports are in registry and said trailing edges are similarly parallel when said trailing edges are in registry.

2. Adjustable valve timing apparatus for an internal combustion engine having at least one combustion chamber, said apparatus comprising a valve housing defining a housing port in open communication with the combustion chamber, a generally cylindrical, driven valve rotor within said valve housing and having at least one passageway through said valve rotor, said passageway defining opposed rotor ports for registry with said housing port upon rotation of said valve body, each of said rotor ports having leading edges, said leading edges being carried over registry with leading edges on said housing port to define an initial point of open registry between said passage and said housing port, each of said rotor ports also having trailing edges, said trailing edges being carried over registry with trailing edges of said housing port to define a final point of open registry between said passage and said housing port, said leading and trailing edges of said housing port being sloped to define opposite sides of a first triangle having a first orientation with respect to the axis of said rotor and said leading and trailing edges of said rotor ports defining opposite sides of a second triangle having a second orientation with respect to the axis of said rotor, said second triangle being inversely oriented with respect to said first triangle whereby said leading edges are parallel when said ports are in registry and said trailing edges are similarly parallel when said trailing edges are in registry.

* * * * *